US012698017B2

(12) United States Patent
Yang et al.

(10) Patent No.: US 12,698,017 B2
(45) Date of Patent: Aug. 4, 2026

(54) MAGLEV BOGIE WITH A CENTERING FUNCTION AND GUIDING METHOD THEREOF

(71) Applicant: JIANGXI UNIVERSITY OF SCIENCE AND TECHNOLOGY, Ganzhou (CN)

(72) Inventors: Jie Yang, Ganzhou (TW); Pengfei Zhan, Ganzhou (TW); Jusong Jiang, Ganzhou (TW)

(73) Assignee: JIANGXI UNIVERSITY OF SCIENCE AND TECHNOLOGY, Ganzhou (CN)

( * ) Notice: Subject to any disclaimer, the term of this patent is extended or adjusted under 35 U.S.C. 154(b) by 430 days.

(21) Appl. No.: 18/533,766

(22) Filed: Dec. 8, 2023

(65) Prior Publication Data

US 2024/0416972 A1 Dec. 19, 2024

(30) Foreign Application Priority Data

Jun. 16, 2023 (CN) ..... 202310717648.X

(51) Int. Cl.
*B60L 13/03* (2006.01)
*B60L 13/06* (2006.01)
(Continued)

(52) U.S. Cl.
CPC . *B61F 5/52* (2013.01); *B61F 3/00* (2013.01)

(58) Field of Classification Search
CPC .... B61F 5/52; B61F 3/00; B60L 13/03; B60L 13/06
(Continued)

(56) References Cited

U.S. PATENT DOCUMENTS

2010/0043667 A1 2/2010 Friedrich
2011/0061559 A1 3/2011 Lund

FOREIGN PATENT DOCUMENTS

CN 102190005 A 9/2011
CN 108406958 A 8/2018
(Continued)

*Primary Examiner* — Troy Chambers
(74) *Attorney, Agent, or Firm* — WPAT, PC

(57) ABSTRACT

The present disclosure relates to a maglev bogie, in particular to a maglev bogie with a centering function and a guiding method thereof. The maglev bogie comprises a maglev guide frame, crank arm brackets, guide wheels, first onboard magnet groups and cylindrical gears, wherein the crank arm brackets are hinged to the four corners of the top and bottom of the maglev bogie, the guide wheels are rotatably connected to the ends of the crank arm brackets, two first onboard magnet groups are slidably connected to each of the two inner sides of the upper part of the maglev guide frame, some of the cylindrical gears are connected to the top of the maglev guide frame where the upper crank arm brackets are hinged, two of the cylindrical gears are rotatably connected to each of the two sides of the top of the maglev guide frame, and every two adjacent cylindrical gears are meshed with each other. With the arrangement of the crank arm brackets, the guide wheels and the cylindrical gears, when the guide wheels on one side is squeezed by overhead track beam and displaced, the guide wheels on the other side can be synchronously driven to displace, so as to ensure a centered state of the maglev guide frame, the first onboard magnet groups, the overhead track beam and beam-borne magnetic track.

8 Claims, 10 Drawing Sheets

(51) Int. Cl.
*B61F 3/00* (2006.01)
*B61F 5/52* (2006.01)

(58) Field of Classification Search
USPC ..... 105/194
See application file for complete search history.

(56) References Cited

FOREIGN PATENT DOCUMENTS

| | | | | | |
|---|---|---|---|---|---|
| CN | 108621857 | A | * | 10/2018 | ..... E01B 25/32 |
| CN | 109056431 | A | * | 12/2018 | ..... E01B 25/305 |
| CN | 209921070 | U | * | 1/2020 | |
| CN | 111224581 | A | | 6/2020 | |
| CN | 111224582 | A | | 6/2020 | |
| CN | 111806244 | A | * | 10/2020 | ..... B61F 5/52 |
| CN | 112960008 | A | * | 6/2021 | ..... B61F 5/52 |
| CN | 113085565 | A | | 7/2021 | |
| CN | 113501025 | A | * | 10/2021 | ..... B60L 13/04 |
| CN | 114056369 | A | * | 2/2022 | ..... B61F 5/52 |
| CN | 218287744 | U | | 1/2023 | |
| CN | 113085565 | B | * | 3/2023 | |
| CN | 219339205 | U | * | 7/2023 | |
| CN | 118269686 | A | * | 7/2024 | ..... B61L 25/025 |
| CN | 120229275 | A | * | 7/2025 | ..... B60L 13/04 |
| JP | 2018533332 | A | * | 11/2018 | ..... B60L 13/06 |
| KR | 20110045957 | A | * | 5/2011 | ..... B65G 35/06 |
| WO | WO-2024239479 | A1 | * | 11/2024 | ..... B61F 9/00 |

* cited by examiner

MAGLEV BOGIE WITH A CENTERING FUNCTION AND GUIDING METHOD THEREOF

CROSS REFERENCE TO RELATED APPLICATIONS

This application claims priority to Chinese Application No. 202310717648.X, filed on Jun. 16, 2023, entitled "Maglev Bogie with A Centering Function and Guiding Method Thereof", which is specifically and entirely incorporated by reference.

FIELD

The present disclosure relates to a maglev bogie, in particular to a maglev bogie with a centering function and a guiding method thereof.

BACKGROUND

As the maglev technology is continuously developed and gradually matured at home and abroad, more and more commercialized maglev rail transit systems emerge. In the application of the maglev technology, the bogie is one of the important components in a maglev train.

In the operation of a maglev train, the levitation of the train is unstable due to the installation error during the manufacturing of the overhead track beam or the lateral force or centrifugal force generated during steering, leading to the displacement of the onboard magnet groups and the beam-borne magnetic track and consequently the dislocation of the onboard magnet groups and the beam-borne magnetic track. Thus, the safety of the maglev train is affected.

SUMMARY

In view of the above problems in the prior art, the present disclosure provides a maglev bogie with a centering function and a guiding method thereof.

The technical scheme of the present disclosure is as follows: A maglev bogie with a centering function and a guiding method thereof are provided. The maglev bogie with a centering function comprises a maglev guide frame, crank arm brackets, guide wheels, first onboard magnet groups, cylindrical gears, middle lugs, resilient devices and a mechanical braking system, wherein the crank arm brackets are hinged to the four corners of the top and bottom of the maglev guide frame, the guide wheels are rotatably connected to the ends of the crank arm brackets, two first onboard magnet groups are slidably connected to the two inner sides of the upper part of the maglev guide frame, some of the cylindrical gears are connected to the top of the maglev guide frame where the upper crank arm brackets are hinged, two of the cylindrical gears are rotatably connected to the two sides of the top part of the maglev guide frame, every two adjacent cylindrical gears are meshed with each other, two middle lugs are arranged at the lateral center of the top surface and the top surface of the maglev guide frame respectively; the resilient devices are hinged between the two sides of the middle lugs and the crank arm brackets that are adjacent to the middle lugs; and the mechanical braking system is arranged between the crank arm brackets and the guide wheels for braking the maglev guide frame.

As a further preferred scheme, the mechanical braking system comprises brake discs and brake calipers, wherein the brake discs are arranged at the upper and lower sides of the guide wheels, the brake calipers are arranged at two sides of the crank arm brackets, and the brake calipers are sleeved outside the corresponding brake discs.

As a further preferred scheme, the maglev bogie further comprises an adjusting and centering mechanism, which comprises first gears, rotating shafts, second gears and connecting racks, wherein the rotating shafts are rotatably connected to the four sides of the top part of the maglev guide frame, the first gears are connected to the tops of the rotating shafts and are meshed with the cylindrical gears connected to the crank arm brackets, the second gears are connected to the bottoms of the rotating shafts, the connecting racks are connected to the sides of the two first onboard magnet groups away from each other on the same side, and the second gears are meshed with the connecting racks.

As a further preferred scheme, the maglev bogie further comprises an adjustable pushing mechanism, which comprises pushing blocks and locking bolts, wherein the pushing blocks are slidably connected to the lower parts of the upper crank arm brackets, the locking bolts are connected to the upper crank arm brackets through threads respectively for locking the pushing blocks.

As a further preferred scheme, the maglev bogie further comprises a magnetic braking system, which comprises slidable pushing blocks, sliding racks, resilient members, connecting shafts, adjusting gears and second onboard magnet groups, wherein the slidable pushing block are slidably connected to the four corners of the maglev guide frame, the pushing blocks can be driven by the crack arm brackets to push the slidable pushing blocks to move when the crack arm brackets swing, the sliding racks are slidably connected to the four corners of the maglev guide frame, the sliding racks can be pressed by the slidable pushing blocks to move with the slidable pushing blocks, the connecting shafts are rotatably connected to the four corners of the upper part of the maglev guide frame, the adjusting gears are connected to the connecting shafts and meshed with the sliding racks, the resilient members are connected between the sliding racks and the maglev guide frame, and the second onboard magnet groups are connected to the connecting shafts.

As a further preferred scheme, the maglev bogie further comprises a power device, which comprises a primary winding and a secondary winding plate of a linear motor, wherein the primary winding of the linear motor is arranged at the center of the top of the maglev guide frame, and the secondary winding plate is arranged on the overhead track beam.

As a further preferred scheme, the maglev bogie further comprises a speed measurement sensor, which is mounted on the top of the maglev guide frame.

As a further preferred scheme, the comprises maglev bogie further comprises an alarm buzzer, range sensors and a controller, wherein the alarm buzzer and the controller are arranged on the maglev guide frame, the range sensors are arranged on the resilient devices, and the range sensors and the alarm buzzer are electrically connected with the controller respectively.

The present disclosure attains the following beneficial effects: 1. With the arrangement of the crank arm brackets, the guide wheels and the cylindrical gears, when the guide wheels on one side is squeezed by the overhead track beam and displaced, the guide wheels on the other side can be synchronously driven to displace, so as to ensure a centered state of the maglev guide frame, the first onboard magnet groups, the overhead track beam and the beam-borne magnetic track.

2. With the arrangement of the adjusting and centering mechanism in the present disclosure, the operation of the first onboard magnet groups can be controlled when the crank arm brackets swing, so that the first onboard magnet groups can be moved and centered with respect to the beam-borne magnetic track, which is to say, the first onboard magnet groups can be controlled to be centered with respect to the beam-borne magnetic track while the adjustment is made, so as to ensure the centered state of the first onboard magnet groups with respect to the beam-borne magnetic track.

Figure 1:
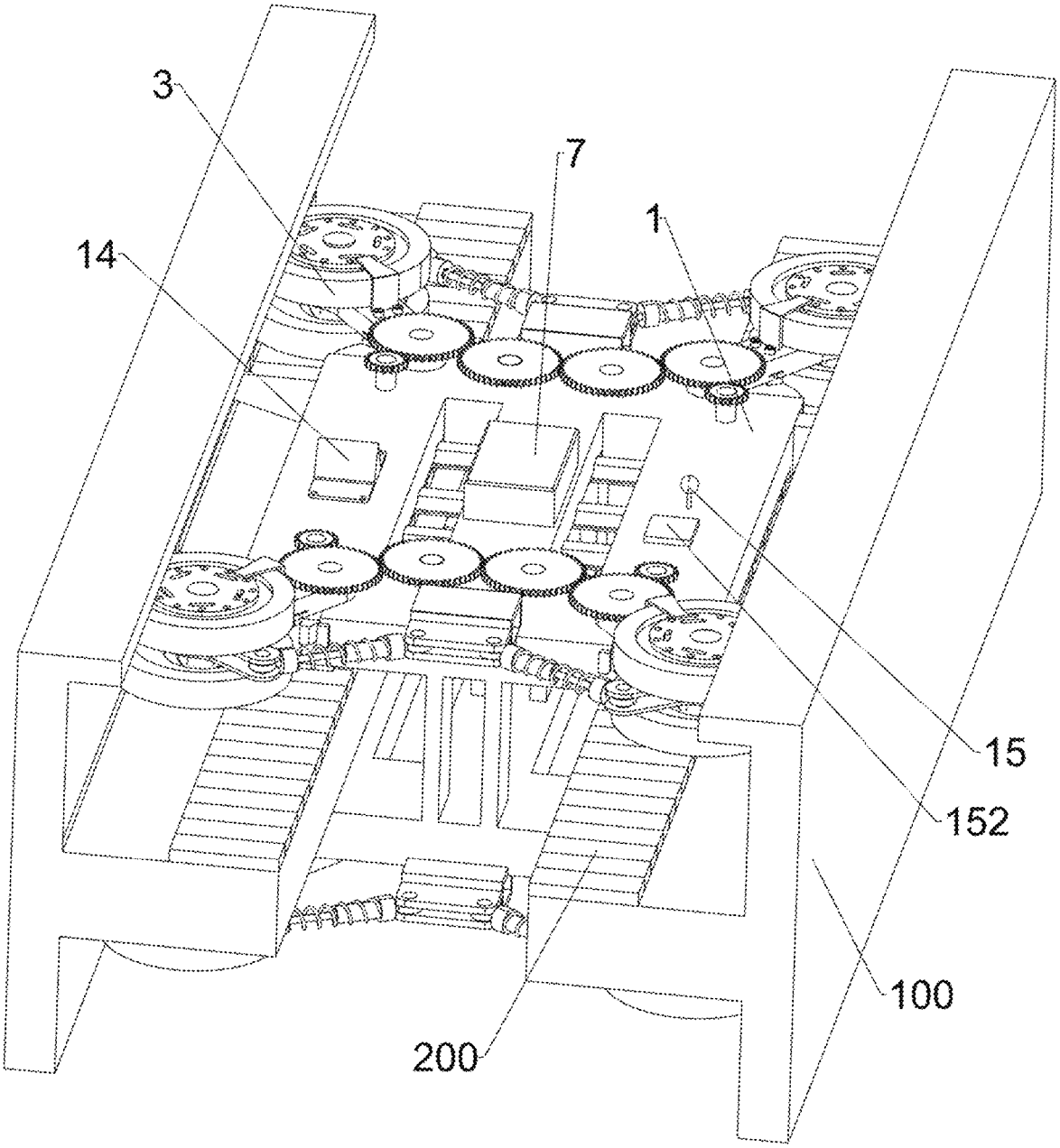
FIG. 1 is a schematic structural diagram of the overhead track beam and beam-borne magnetic track in the present disclosure.

In the figures: 1—maglev guide frame; 2—crank arm bracket; 3—guide wheel; 31—brake disc; 32—brake caliper; 4—first onboard magnet group; 6—cylindrical gear; 7—primary of linear motor; 8—middle lug; 9—resilient device; 101—first gear; 102—rotating shaft; 103—second gear; 104—connecting rack; 121—pushing block; 122—locking bolt; 131—slidable pushing block; 132—sliding rack; 133—resilient member; 134—connecting shaft; 135—second onboard magnet group; 136—adjusting gear; 14—speed measurement sensor; 15—alarm buzzer; 151—range sensor; 152—controller; 100—overhead track beam; 200—beam-borne magnetic track.

DETAILED DESCRIPTION

The technical scheme will be further explained below in specific embodiments. It should be noted that the words denoting directions such as "top", "bottom", "left" and "right" mentioned herein are only intended to indicate the orientations of the shown structures in the corresponding drawings. The ordinal numerals for the parts used herein, such as "first" and "second", etc., are only intended to distinguish the described objects, without any sequential or technical meaning. Unless otherwise specified, the words "connection" and "coupling" as used herein encompass direct and indirect connections (coupling).

Embodiment 1

A maglev bogie with a centering function and a guiding method thereof are provided. As shown in FIGS. 1-6, the maglev bogie with a centering function comprises a maglev guide frame 1, crank arm brackets 2, guide wheels 3, first onboard magnet groups 4, cylindrical gears 6, middle lugs 8, resilient devices 9 and a mechanical braking system, wherein the crank arm brackets 2 are hinged to the four corners of the top and bottom of the maglev guide frame 1, the guide wheels 3 are rotatably connected to the tail ends of the crank arm brackets 2, the guide wheels 3 contact with the inner walls of the overhead track beam 100 when the maglev guide frame 1 is located in the overhead track beam 100, two first onboard magnet groups 4 are slidably connected to the left and right inner sides of the top part of the maglev guide frame 1, some of the cylindrical gears 6 are connected to the top of the maglev guide frame 1 where the upper crank arm brackets 2 are hinged, two of the cylindrical gears 6 are rotatably connected to the front and rear sides of the top of the maglev guide frame 1 respectively, and every two adjacent cylindrical gears 6 are meshed with each other, two middle lugs 8 are arranged at the lateral center of the top surface and the top surface of the maglev guide frame 1 respectively, the two middle lugs 8 are arranged at front and rear positions respectively, resilient devices 9 are hinged between the left and right sides of the middle lugs 8 and the crank arm brackets 2 that are adjacent to the middle lugs 8, and the mechanical braking system is arranged between the crank arm brackets 2 and the guide wheels 3 for braking the maglev guide frame 1.

Figure 6:
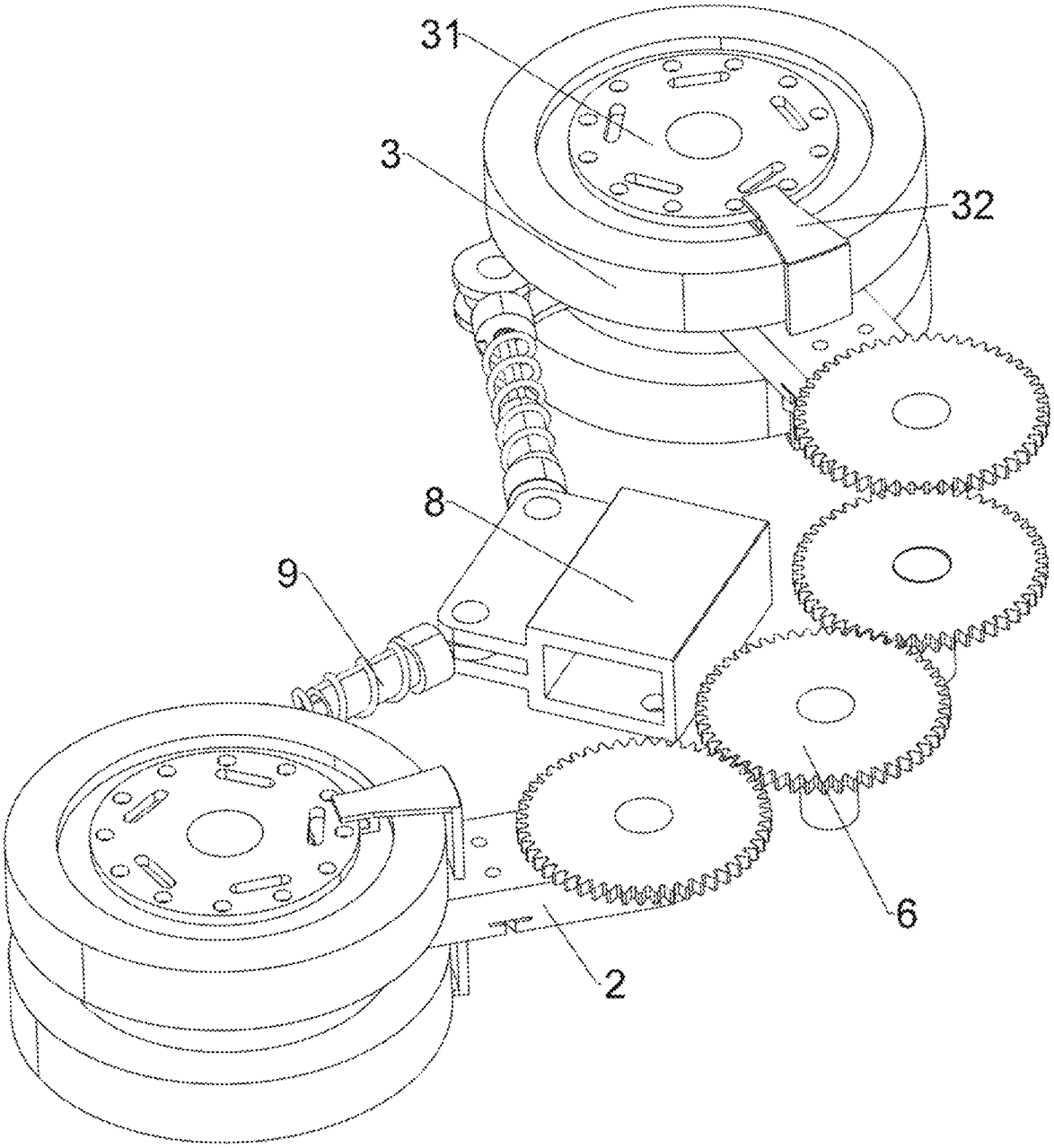
FIG. 6 is a schematic diagram illustrating the connection relationship among the crank arm bracket, the guide wheel and the cylindrical gear in the present disclosure.

As shown in FIG. 6, the mechanical braking system comprises brake discs 31 and brake calipers 32, wherein the brake discs 31 are arranged at the upper and lower sides of the guide wheels 3, the brake calipers 32 are arranged at the upper and lower sides of the crank arm brackets 2, the brake calipers 32 are sleeved outside the brake discs 31; when the brake calipers 32 act, the brake shoes in the brake calipers 32 contact with the brake discs 31 and thereby friction is generated, so that the guide wheels 3 stop rolling, and friction is generated between the guide wheels 3 and the overhead track beam 100 attain a braking effect.

During the use of the bogie, at positions where the overhead track beam 100 is narrower or turned, the narrower or turned side of the overhead track beam 100 presses the guide wheels 3 in contact with it, thus driving the crank arm brackets 2 on the same side to swing, and the crank arm brackets 2 on the other side swing at the same time by means of the sequential meshed transmission of the four cylindrical gears 6, so that the guide wheels 3 on both sides contract at the same time, thereby the first onboard magnet groups 4 on the maglev guide frame 1 are centered with respect to the beam-borne magnetic track. Similarly, at positions where the overhead track beam 100 is widened, the guide wheels 3 on both sides can be controlled to extend at the same time. In that way, the maglev guide frame 1, the first onboard magnet groups 4, the overhead track beam 100 and the beam-borne magnetic track 200 can be maintained in a centered state at positions where the overhead track beam 100 is narrowed or widened. When the crank arm brackets 2 swing, the resilient devices 9 contract or extend at the same time; since the resilient devices 9 can't contract further when the contraction reaches a limit, the swing of the crank arm brackets 2 is limited.

Embodiment 2

Figure 2:
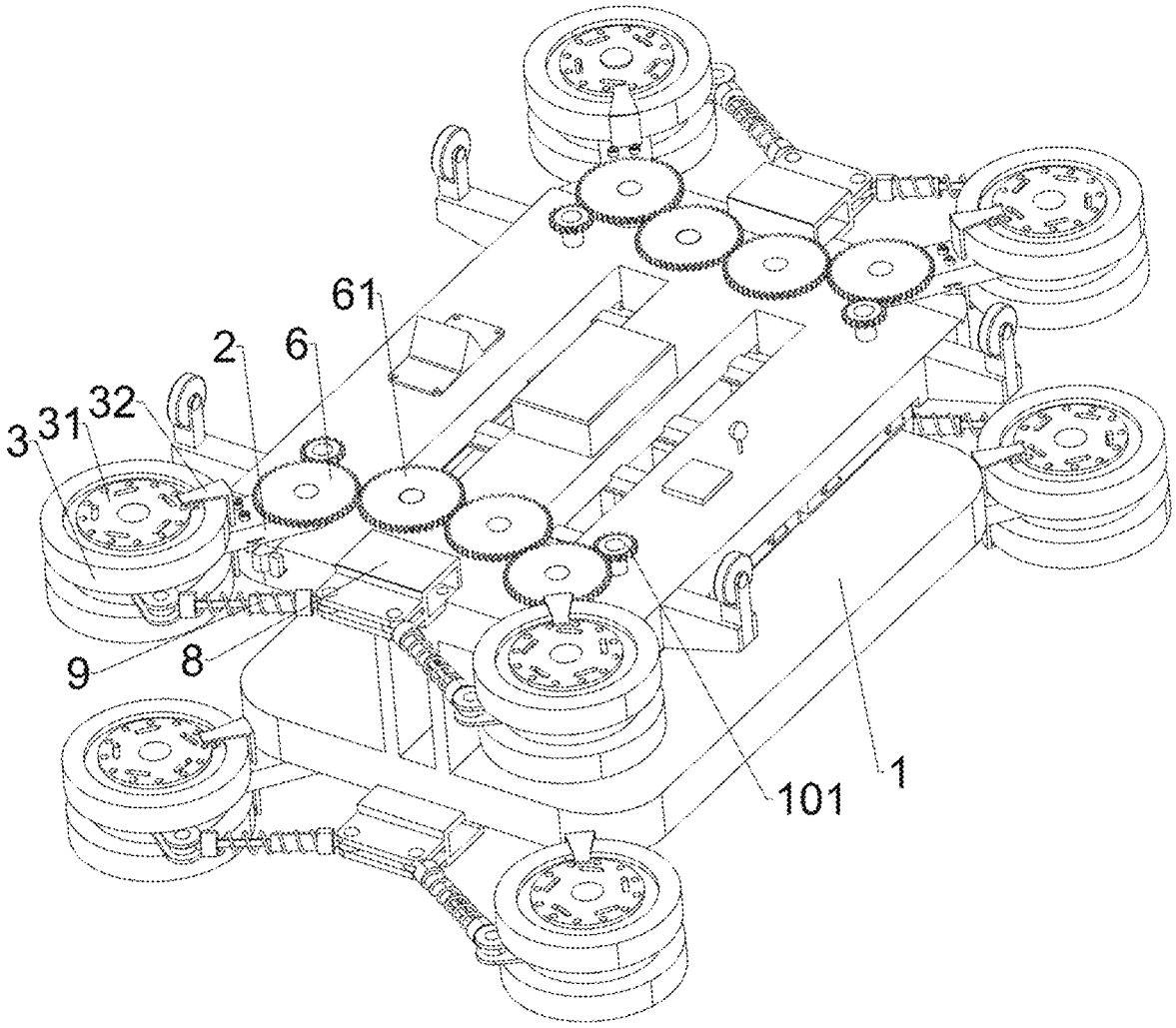
FIG. 2 is a schematic structural diagram of the maglev bogie in the present disclosure.
Figure 5:
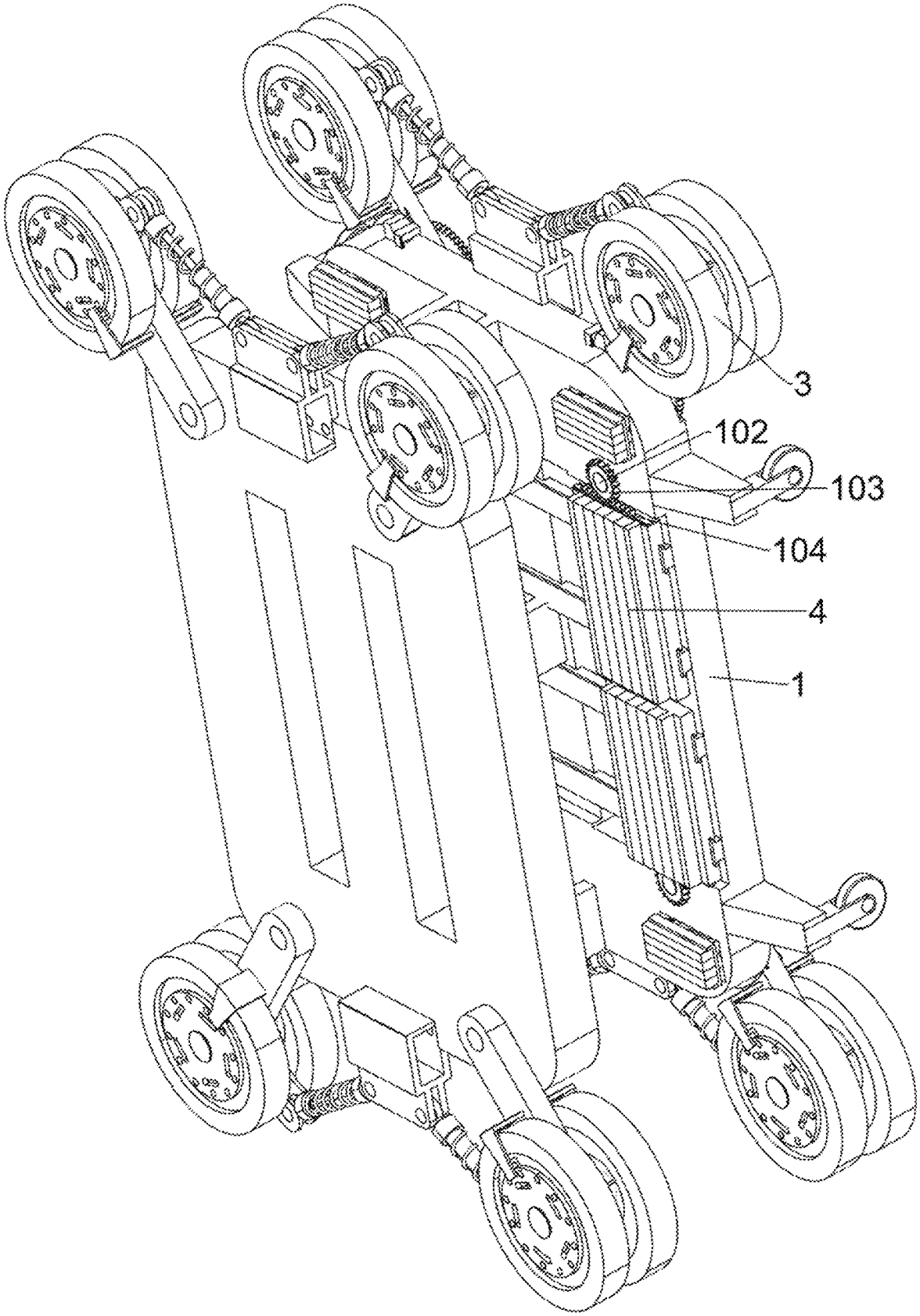
FIG. 5 is a schematic structural diagram of the adjusting and centering mechanism in the present disclosure.
Figure 7:
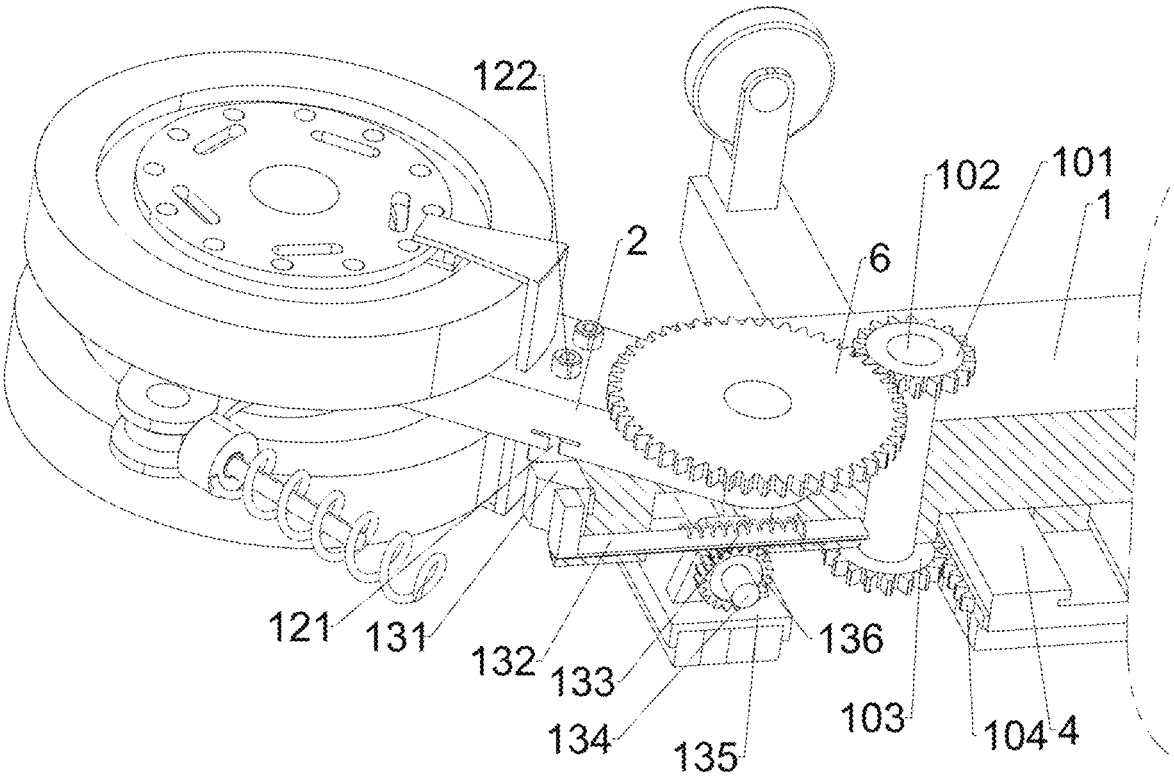
FIG. 7 is a schematic diagram of a first type of structure of the adjustable pushing mechanism and the magnetic braking system in the present disclosure.

Based on the embodiment 1, as shown in FIGS. 2, 5 and 7, the maglev bogie further comprises an adjusting and centering mechanism, which comprises first gears 101, rotating shafts 102, second gears 103 and connecting racks 104, wherein the rotating shafts 102 are rotatably connected to the four sides of the top part of the maglev guide frame 1, the first gears 101 are connected to the tops of the rotating shafts 102 and are meshed with the cylindrical gears 6 connected to the crank arm brackets 2, the second gears 102 are connected to the bottoms of the rotating shafts 101, the connecting racks 103 are connected to the sides of the two first onboard magnet groups 4 away from each other on the same side, and the second gears 103 are meshed with the connecting racks 104.

In the centering process, when the crank arm brackets 2 swing to drive the cylindrical gears 6 on it to rotate, the connecting racks 104 can be driven via the first gears 101, the rotating shafts 102 and the second gears 103 to move, and the movement of the connecting racks 104 can drive the first onboard magnet groups 4 to move, so that the first onboard magnet groups 4 are controlled to move and get centered with respect to the beam-borne magnetic track 200 in the centering process.

Figure 9:
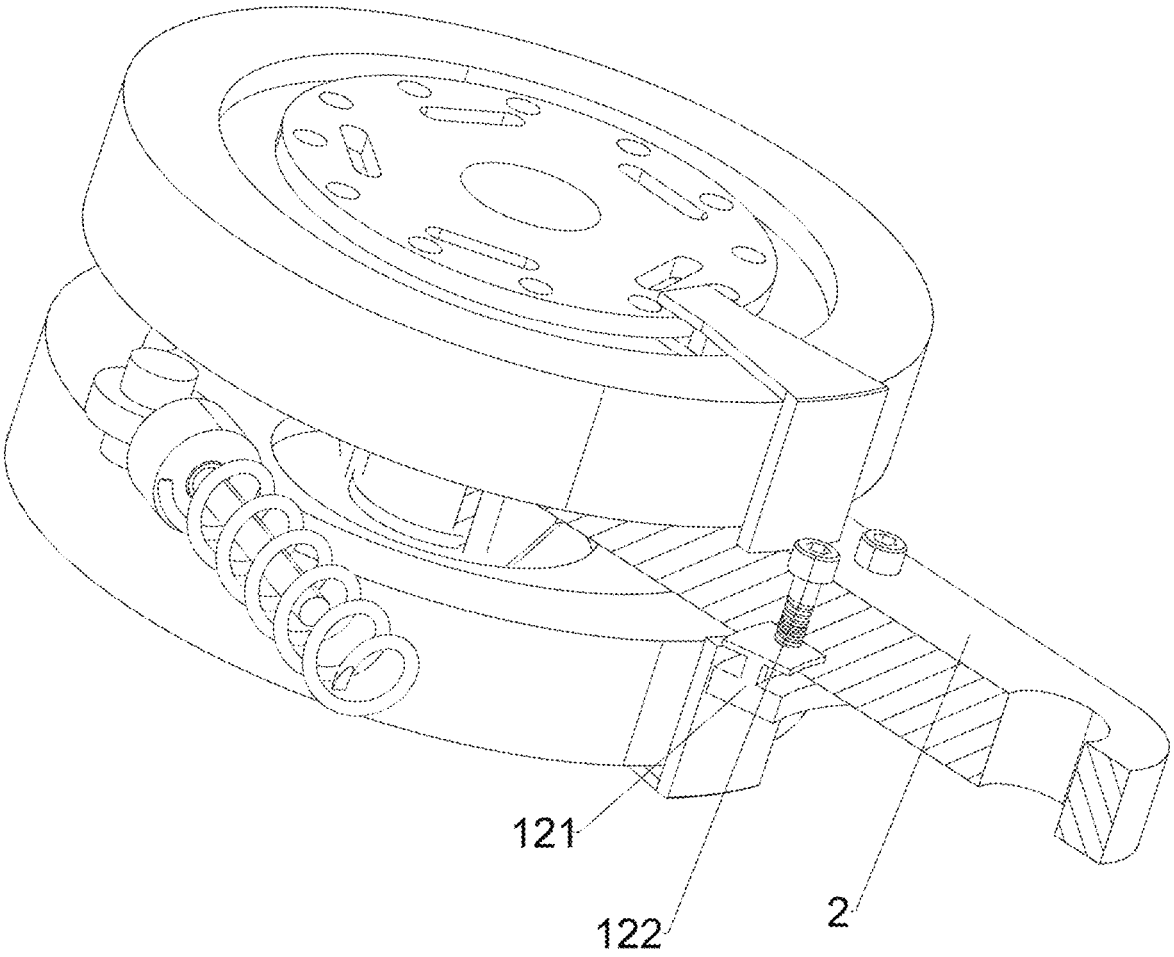
FIG. 9 is a schematic structural diagram of the adjustable pushing mechanism in the present disclosure.
Figure 10:
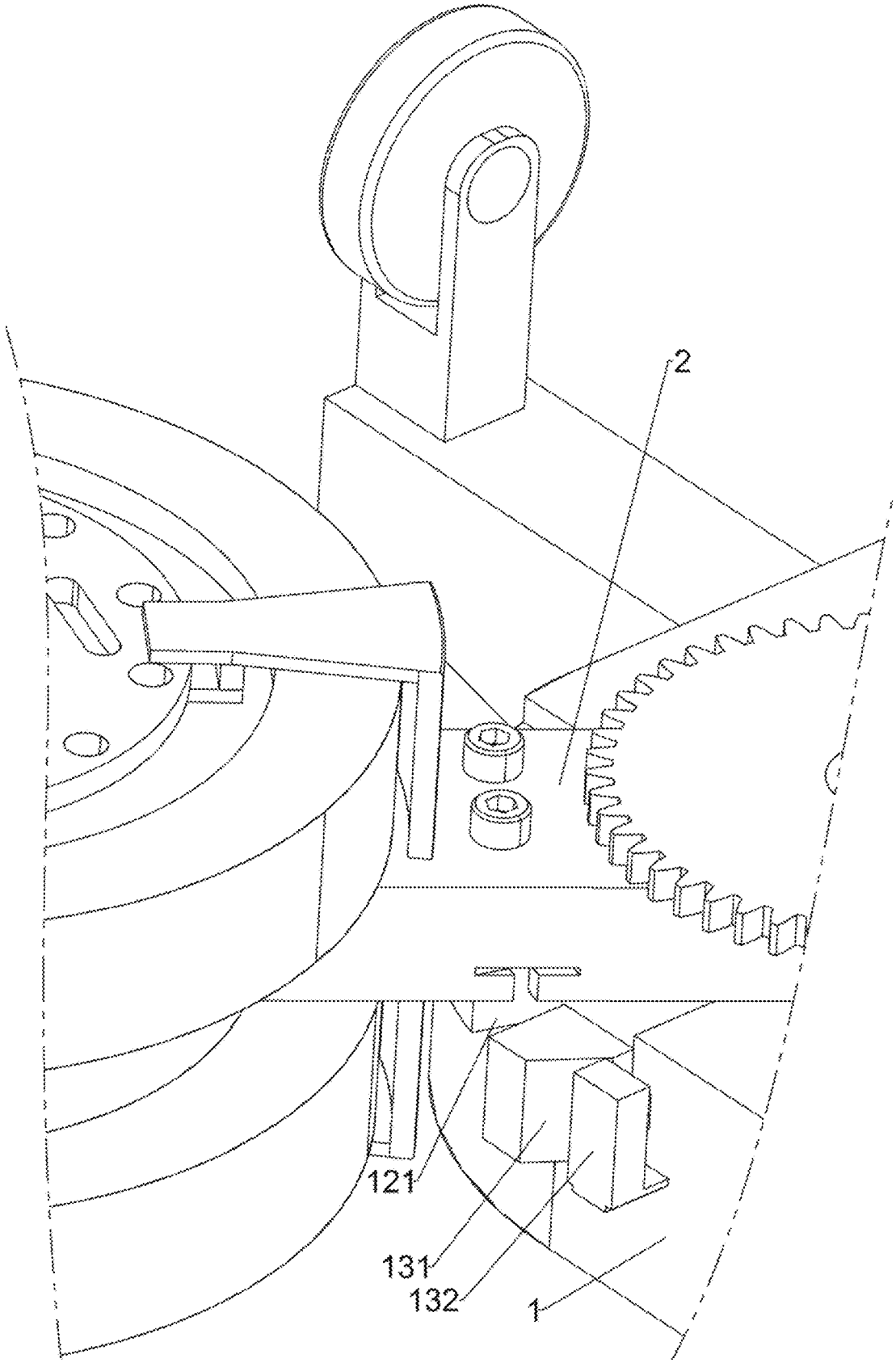
FIG. 10 is a schematic diagram of a second type of structure of the adjustable pushing mechanism and the magnetic braking system in the present disclosure.

As shown in FIGS. 7, 9 and 10, the maglev bogie further comprises an adjustable pushing mechanism, which comprises pushing blocks 121 and locking bolts 122, wherein the pushing blocks 121 are slidably connected to the lower parts of the upper crank arm brackets 2, and the locking bolts 122 are connected to the upper crank arm brackets 2 through threads; the locking bolts 122 can abut against the pushing blocks 121 to fix the pushing blocks 121 when they are turned; each locking bolts 122 are provided with an hexagonal hole in the top, so that it can be turned conveniently.

Figure 8:
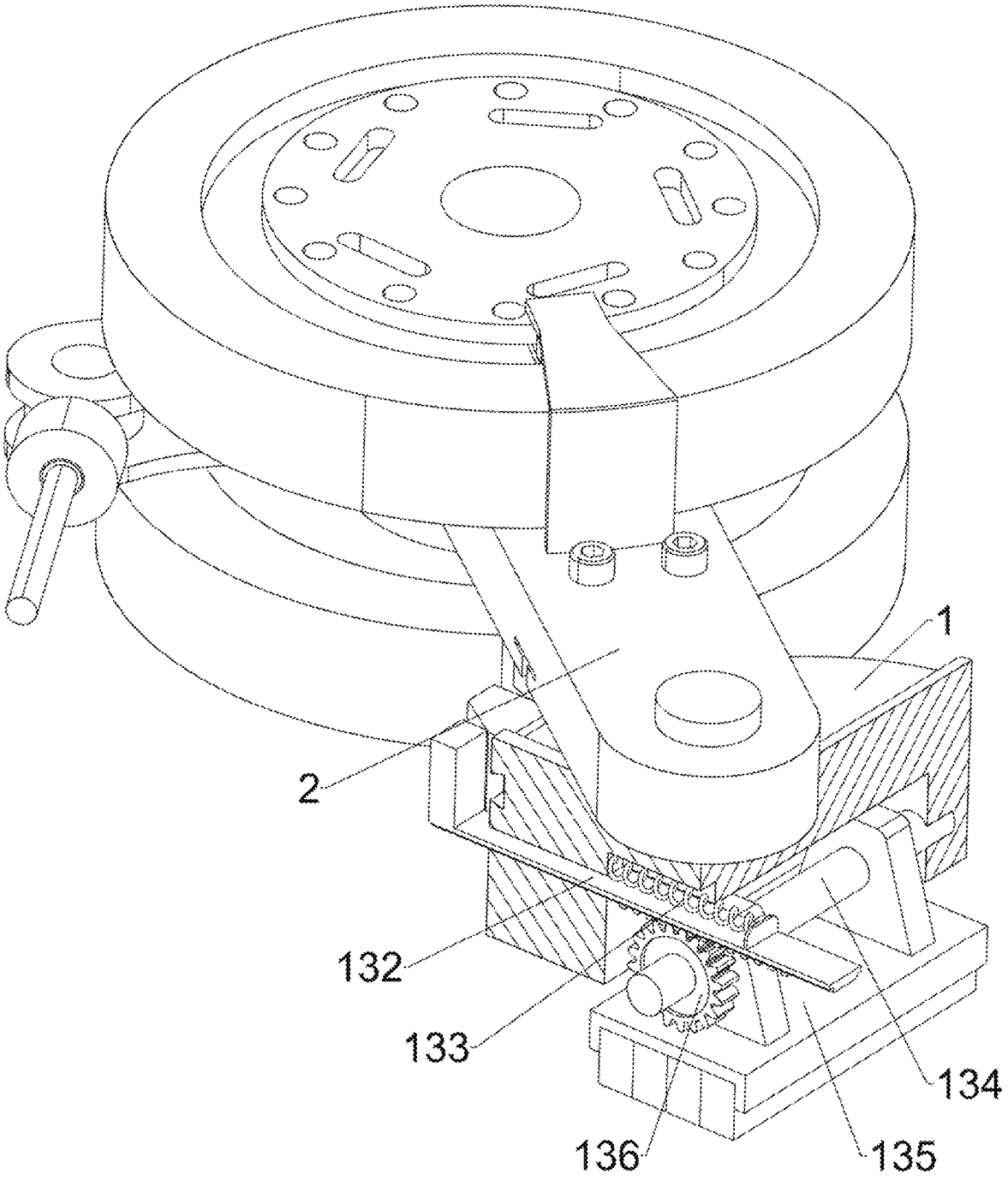
FIG. 8 is a schematic structural diagram of the magnetic braking system in the present disclosure.

As shown in FIGS. 7, 8 and 10, the maglev bogie further comprises a magnetic braking system, which comprises slidable pushing blocks 131, sliding racks 132, resilient members 133, connecting shafts 134, adjusting gears 136 and second onboard magnet groups 135, wherein the slidable pushing blocks 131 are slidably connected to the four corners of the maglev guide frame 1, and the pushing blocks 121 are driven by the crank arm brackets 2 to push the slidable pushing blocks 131 to move when the crank arm brackets 2 swing; the sliding racks 132 are slidably connected to the four corners of the maglev guide frame 1, and can slide back and forth along the maglev guide frame 1; the front side of each sliding rack 132 is provided with a protrusion, the side of the slidable pushing block 131 near the sliding rack 132 is provided with a bevel surface, and the bevel surface of the slidable pushing block 131 can press the protrusion of the sliding rack 132 press the sliding rack 132 to move when the slidable pushing block 131 moves; the connecting shafts 134 are rotatably connected to the four corners of the upper part of the maglev guide frame 1, the adjusting gears 136 are connected to the connecting shafts 134 and meshed with the sliding racks 132; the resilient members 133 are connected between the sliding racks 132 and the maglev guide frame 1; the second onboard magnet groups 135 are connected to the connecting shafts 134; the upper part of the maglev guide frame 1 is provided with notches to accommodate the second onboard magnet groups 135, and the second onboard magnet groups 135 can rotate at the notches.

When the crank arm brackets 2 swing, they drive the pushing blocks 121 to move; then, the pushing blocks 121 contact with the slidable pushing blocks 131 and press the slidable pushing blocks 131 to move; the slidable pushing blocks 131 move and press the sliding rack 132 to move and the resilient members 133 are deformed; the sliding racks 132 move to drive the connecting shafts 134 via the adjusting gears 136 to rotate, so that the second onboard magnet groups 135 are turned over. After the second onboard magnet groups 135 is turned over, the bottom surface of each second onboard magnet group 135 swings forward and aligns with the beam-borne magnetic track 200; the magnetic polarity of the bottom surface of the second onboard magnet group 135 is the same as that of the beam-borne magnetic track 200, thereby the second onboard magnet groups 135 can be pushed to move backward under the repulsion, and the entire maglev guide frame 1 is braked by means of magnetism.

As shown in FIG. 1, the maglev bogie further comprises a power device, which comprises a primary winding 7 and a secondary winding plate of a linear motor, wherein primary winding 7 of the linear motor is mounted at the center of the top of the maglev guide frame 1, and the secondary winding plate is mounted on the overhead track beam 100, and is made of an aluminum-iron composite material. When three-phase symmetrical alternating current is introduced into the primary winding 7 of the linear motor, a traveling wave magnetic field is generated at the air gap between the primary winding 7 of the motor and an induction plate, and an eddy current is generated in the induction plate under the effect of the traveling wave magnetic field, the secondary winding plate generates force under a combined action of the eddy current and the magnetic field in the air gap, thereby provides traction force required for the bogie to operate.

As shown in FIG. 1, the maglev bogie further comprises a speed measurement sensor 14, which is mounted on the top of the maglev guide frame 1 and can detect the speed of the maglev train during running.

Figure 3:
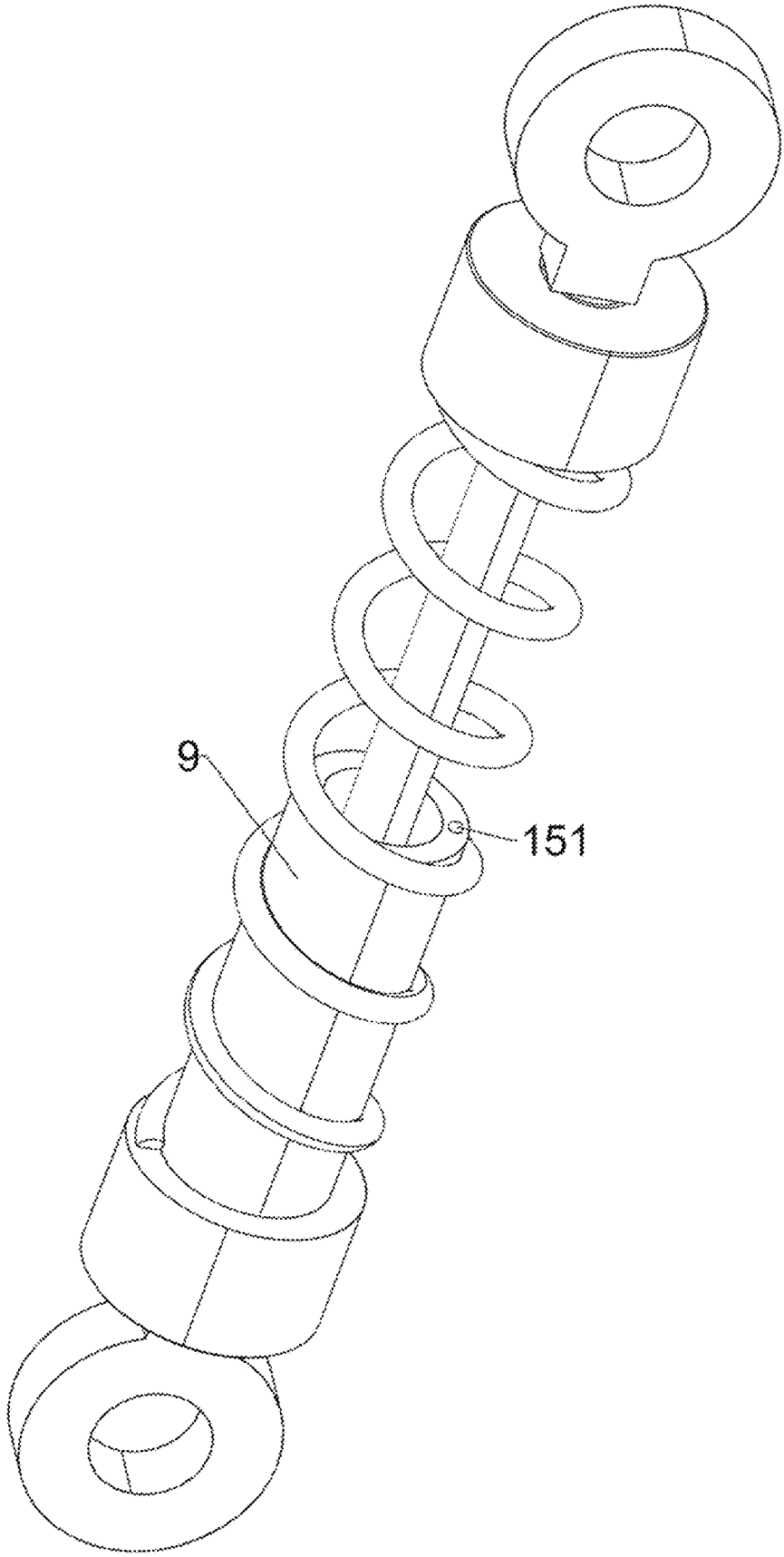
FIG. 3 is a schematic structural diagram of the resilient device and the range sensor in the present disclosure.
Figure 4:
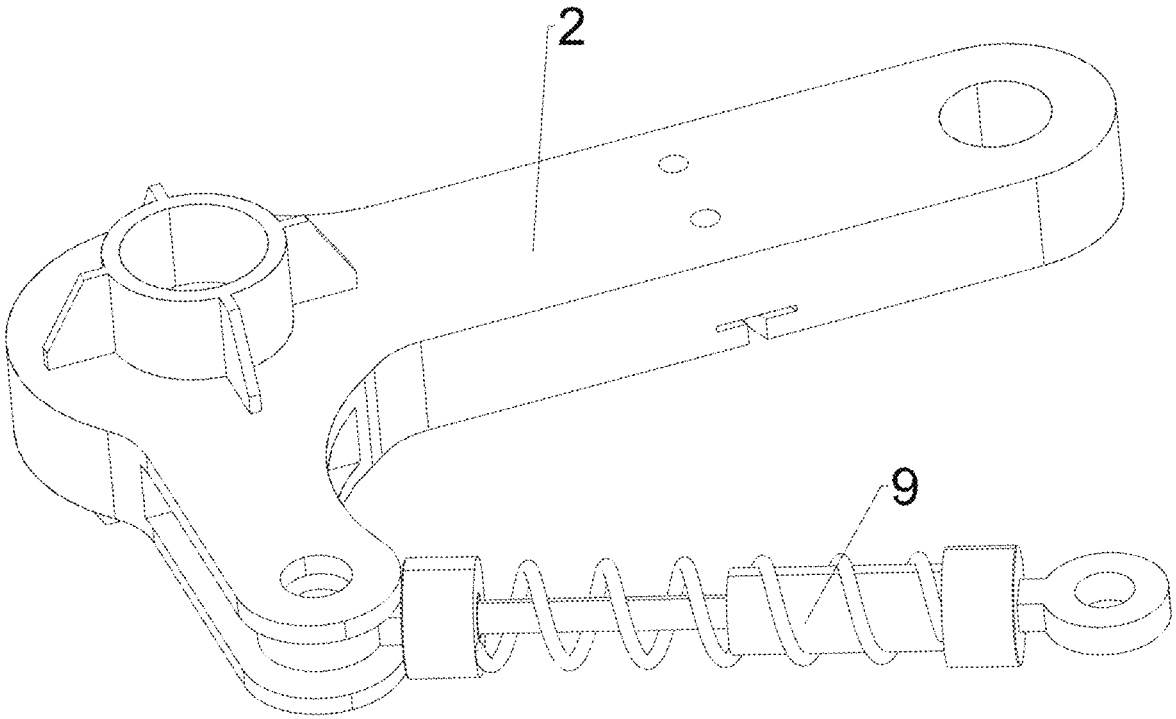
FIG. 4 is a schematic structural diagram of the crank arm bracket and the resilient device in the present disclosure.

As shown in FIGS. 1 and 3, the maglev bogie further comprises an alarm buzzer 15, range sensors 151 and a controller 152, wherein the alarm buzzer 15 and the controller 152 are arranged on the maglev guide frame 1, and the range sensors 151 are arranged on the resilient devices 9; the controller 152 is electrically connected with the range sensors 151 and the alarm buzzer 15 respectively; the resilient device 9 is composed of a fixed part, a telescopic part and a spring part, and the range sensor 151 is mounted on the fixed part; when the resilient device 9 is compressed to a certain extent so that the range sensor 151 detects that the distance between the end of the telescopic part and the range sensor 151 exceeds a preset value, the range sensor 151 can send a signal to the controller 152 to control the operation of the alarm buzzer 15 to give an alarm.

It should be noted that the above embodiments are only intended to illustrate the technical scheme of the present disclosure, but doesn't constitute any limitation to the scope of protection of the present disclosure. Although the present disclosure is described in detail in some preferred embodiments, it should be understood by those skilled in the art that various modifications or equivalent replacements may be made to the technical scheme of the present disclosure without departing from the essence and scope of the technical scheme of the present disclosure.

The invention claimed is:

1. A maglev bogie with a centering function, comprising: a maglev guide frame (1) having a top with two sides, a bottom and four corners, crank arm brackets (2), guide wheels (3), first onboard magnet groups (4), cylindrical gears (6), middle lugs (8), resilient devices (9) and a mechanical braking system, wherein the crank arm brackets (2) are hinged to the four corners of the top and bottom of the maglev guide frame (1), the guide wheels (3) are rotatably connected to the ends of the crank arm brackets (2), the first onboard magnet groups (4) are slidably connected to the two inner sides of the upper part of the maglev guide frame (1), some of the cylindrical gears (6) are connected to the top of the maglev guide frame (1) where the upper crank arm brackets (2) are hinged, two of the cylindrical gears (6) are rotatably connected to each of the two sides of the top of the maglev guide frame (1), every two adjacent cylindrical gears (6) are meshed with each other, the middle lugs (8) are arranged at lateral centers of the top surface and the top surface of the maglev guide frame (1) respectively, the resilient devices (9) are hinged between the middle lugs (8) and the crank arm brackets (2) that are adjacent to the middle lugs (8), the mechanical braking system is arranged between the crank arm brackets (2) and the guide wheels (3) for braking the maglev guide frame (1).

2. The maglev bogie with a centering function of claim 1, wherein the mechanical braking system comprises brake discs (31) and brake calipers (32), wherein the brake discs (31) are arranged at the upper and lower sides of the guide wheels (3), the brake calipers (32) are arranged at two sides of the crank arm brackets (2), and the brake calipers (32) are sleeved outside the corresponding brake discs (31).

3. The maglev bogie with a centering function of claim 1, further comprising an adjusting and centering mechanism, which comprises first gears (101), rotating shafts (102), second gears (103) and connecting racks (104), wherein the rotating shafts (102) are rotatably connected to the four sides of the top part of the maglev guide frame (1), the first gears (101) are connected to the tops of the rotating shafts (102) and are meshed with the cylindrical gears (6) connected to the crank arm brackets (2), the second gears (103) are connected to the bottoms of the rotating shafts (102), the connecting racks (104) are connected to the sides of the two first onboard magnet groups (4) away from each other on the same side, and the second gears (103) are meshed with the connecting racks (104).

4. The maglev bogie with a centering function of claim 1, further comprising an adjustable pushing mechanism, which comprises pushing blocks (121) and locking bolts (122), wherein the pushing blocks (121) are slidably connected to the lower parts of the upper crank arm brackets (2), the locking bolts (122) are connected to the upper crank arm brackets (2) through threads respectively for locking the pushing blocks (121).

5. The maglev bogie with a centering function of claim 4, further comprising a magnetic braking system, which comprises slidable pushing blocks (131), sliding racks (132), resilient members (133), connecting shafts (134), adjusting gears (136) and second onboard magnet groups (135), wherein the slidable pushing block (131) are slidably connected to the four corners of the maglev guide frame (1), the pushing blocks (121) can be driven by the crack arm brackets (2) to push the slidable pushing blocks (131) to move when the crack arm brackets (2) swing, the sliding racks (132) are slidably connected to the four corners of the maglev guide frame (1), the sliding racks (132) can be pressed by the slidable pushing blocks (131) to move with the slidable pushing blocks (131), the connecting shafts (134) are rotatably connected to the four corners of the upper part of the maglev guide frame (1), the adjusting gears (136) are connected to the connecting shafts (134) and meshed with the sliding racks (132), the resilient members (133) are connected between the sliding racks (132) and the maglev guide frame (1), and the second onboard magnet groups (135) are connected to the connecting shafts (134).

6. The maglev bogie with a centering function of claim 1, further comprising a power device, which comprises a primary winding (7) and a secondary winding plate of a linear motor, wherein the primary winding (7) of the linear motor is arranged at the center of the top of the maglev guide frame (1), and the secondary winding plate is arranged on the overhead track beam (100).

7. The maglev bogie with a centering function of claim 1, further comprising a speed measurement sensor (14), which is mounted on the top of the maglev guide frame (1).

8. The maglev bogie with a centering function of claim 1, further comprising an alarm buzzer (15), range sensors (151) and a controller (152), wherein the alarm buzzer (15) and the controller (152) are arranged on the maglev guide frame (1), the range sensors (151) are arranged on the resilient devices (9), and the range sensors (151) and the alarm buzzer (152) are electrically connected with the controller (152) respectively.

* * * * *